United States Patent [19]

Yokoyama

[11] Patent Number: 4,800,468

[45] Date of Patent: Jan. 24, 1989

[54] HEADLAMP FOR VEHICLE

[75] Inventor: Sakae Yokoyama, Kawasaki, Japan

[73] Assignee: Stanley Electric Co., Ltd., Tokyo, Japan

[21] Appl. No.: 123,761

[22] Filed: Nov. 23, 1987

[30] Foreign Application Priority Data

Nov. 29, 1986 [JP] Japan ..... 61-184088[U]

[51] Int. Cl.[4] ..... F21V 7/09

[52] U.S. Cl. ..... 362/61; 362/297; 362/346

[58] Field of Search ..... 362/296, 297, 346, 348, 362/61, 241

[56] References Cited

U.S. PATENT DOCUMENTS

| | | | |
|---|---|---|---|
| 1,655,571 | 1/1928 | Sims | 362/236 |
| 1,737,027 | 11/1929 | Schoonmaker | 362/297 X |
| 1,859,854 | 5/1932 | Waustab | 362/241 |
| 3,309,554 | 3/1967 | DeLorenzo | 362/296 X |
| 4,081,667 | 3/1978 | Lewin et al. | 362/296 |
| 4,347,554 | 8/1982 | Matsushita | 362/346 X |
| 4,404,620 | 9/1983 | Takahashi et al. | 362/346 X |
| 4,523,262 | 6/1985 | Shinkai | 362/296 X |
| 4,564,888 | 1/1986 | Lewin et al. | 362/296 X |
| 4,587,601 | 5/1986 | Collins | 362/241 X |
| 4,683,525 | 7/1987 | Camm | 362/297 X |
| 4,719,546 | 1/1988 | Spitz | 362/241 X |

FOREIGN PATENT DOCUMENTS 52-74778 6/1977 Japan .

*Primary Examiner*—Ira S. Lazarus
*Assistant Examiner*—Richard R. Cole
*Attorney, Agent, or Firm*—Frishauf, Holtz, Goodman & Woodward

[57] ABSTRACT

A vehicle headlamp having a reflector formed of molded resin. A suitable side of a rim portion of the reflector is extended in a direction of an optical axis of the reflector to form a carrier portion, the carrier portion having at least one sub-reflecting surface integrally formed thereon during molding of the reflector, the sub-reflecting surfaces extending along the optical axis direction of the headlamp for reflecting light impinging thereon.

7 Claims, 1 Drawing Sheet

HEADLAMP FOR VEHICLE

BACKGROUND OF THE INVENTION

The present invention relates to a headlamp for a vehicle. Further, the present invention provides a simple production technique for a headlamp having excellent visibility by the provision of an auxiliary reflector integral with a reflector formed of resin material.

A conventional vehicle headlamp provided with a sub-reflector is disclosed, for example, in Japanese Utility Model Application Laid-Open Specification No. 52-74,778, in which a separately formed sub-reflector is fixed within a lamp body by a fixing means such as caulking, as shown in the drawing of said Japanese Specification, said sub-reflector comprising a reflecting portion for reflecting light and a supporting portion for supporting said reflecting portion at a predetermined position.

In the aforementioned prior art construction, a separately formed sub-reflector is used, and therefore, even if the aforesaid supporting portion is formed to be small so that the supporting portion will not intercept the irradiated light from the lamp, a shadow unavoidably occurs in a reflector. For this reason, an unevenness of illumination occurs in external appearance when the lamp is lit, thus posing a problem in terms of external appearance. The occurrence of the shadow results in a loss of illuminance of irradiation of the lamp. This prior art construction also poses a practical problem in that such an arrangement cannot be employed for a vehicle headlamp which requires maximum illumination. Furthermore, there is another problem in terms of production in that the manufacturing process becomes complicated since a separately formed article is mounted.

SUMMARY OF THE INVENTION

It is an object of the present invention to overcome those problems noted above with respect to the prior art.

For solving the above-described disadvantages, according to the present invention, there is provided a vehicle headlamp having a reflector formed of a resin, characterized in that a suitable side of a rim portion of said reflector is extended in a direction of an optical axis of said reflector to form a carrier portion, said carrier portion being integrally formed with at least one or more sub-reflecting surfaces along said optical-axis direction.

DETAILED DESCRIPTION OF THE INVENTION

Figure 1:
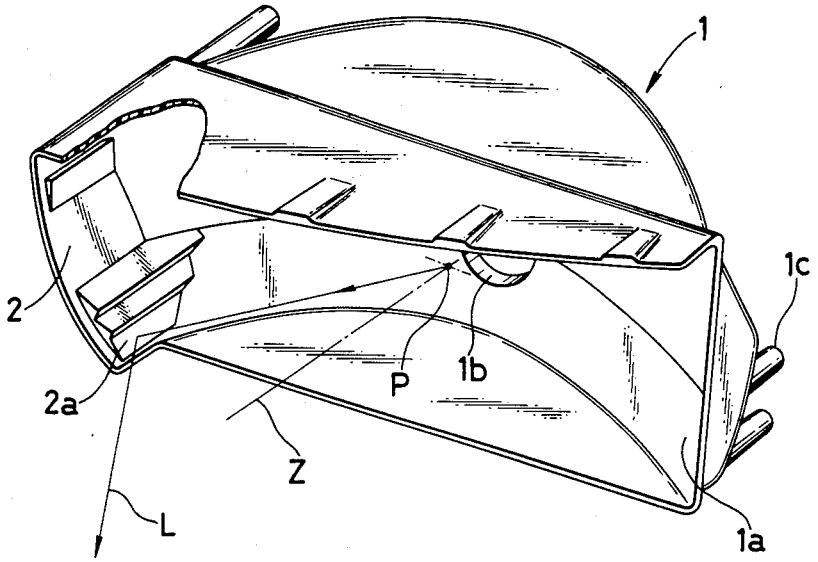
FIG. 1 is a perspective view showing essential parts of one embodiment of a vehicle headlamp according to the present invention.

Referring to FIG. 1, a vehicle headlamp comprises a reflector 1 formed by injection molding or the like using a material such as a resin. Simultaneously with the molding of reflector 1, a main reflecting surface 1*a*, a lamp mounting portion 1*b*, a boss 1*c* for mounting to a body and the like are formed, and at the same time a rim portion which is a peripheral edge portion of the main reflecting surface 1*a* is formed extending in a direction of an optical axis Z to form a carrier portion 2.

The carrier portion 2 can be formed at either side of the rim portion. The carrier portion 2 may be provided at a position in which the reflected light is directed at the object. More specifically, if irradiation is desired for the side and front portion outside the vehicle, the rim portion at the position of the internal side when the reflector is mounted on the vehicle body may be extended.

The thus formed carrier portion 2 is integrally formed with a plurality of sub-reflecting surfaces 2*a* which extend along the aforesaid optical axis Z so as to reflect a light beam from a light source in a predetermined direction. When the reflector 1 is molded, the main reflecting surface 1*a* as well as the sub-reflecting surfaces 2*a* are simultaneously formed. By the formation of the reflector 1 in a manner as described above, the sub-reflecting surfaces 2*a* reflect a direct light from a lamp filament at a position P of the light source to form the same into a sub-light beam L directed in a predetermined direction.

Figure 2:
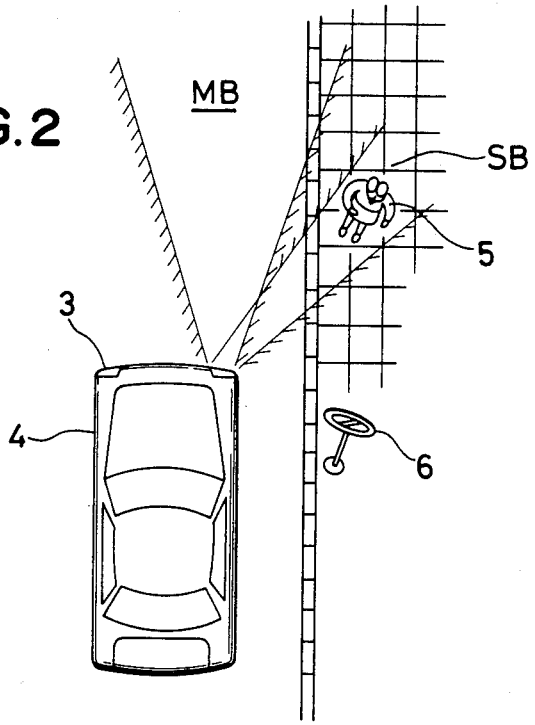
FIG. 2 illustrates the operation of the headlamp of FIG. 1.

FIG. 2 illustrates the operating state when a vehicle headlamp 3 according to the present invention is mounted on a vehicle 4, showing in this embodiment an example wherein the headlamp irradiates the front and side of the, vehicle 4. By the provision of the sub-reflecting surfaces 2*a*, the headlamp 3 provides an essentially main irradiation range MB produced by the main reflecting surface 1*a* and a subirradiation range SB to the front and side portion of the vehicle produced by the sub-reflecting surfaces 2*a*, whereby one can easily see a pedestrian 5 or a signpost 6 which is relatively closely located. It would have been impossible to clearly see the pedestrian 5 or the signpost 6 only by the light produced in the main irradiation range SB.

The aforesaid sub-reflecting surfaces 2*a* can be mounted on the carrier portion 2 in any shape in an optical sense. However, it is ordinarily a practice that a mold for injection molding or the like used when the reflector 1 is molded is fabricated so that the mold is slidably moved in the Z direction of the optical axis, and therefore the subreflecting surfaces are preferably formed in the form of a web or strip along the optical axis Z in view of readiness of release from the mold. In addition, it is needless to say that the integral provision of the sub-reflecting surfaces 2*a* as described above requires no separate additional fabrication or assembly step for providing the subreflecting surface 2*a*. It can be manufactured by exactly the same operating procedure as a prior art headlamp which is not provided with the sub-reflector of the type described hereinabove.

As described above, according to the present invention, a vehicle headlamp is designed so that a suitable side of a rim portion of the reflector is extended in a direction of an optical axis of the reflector to form a carrier portion being integrally formed with, one or more sub-reflecting surfaces extending along the optical axis direction. Therefore, the sub-reflecting surfaces can be formed without the need of an additional member such as a support and without the need of additional steps such as spot welding or caulking, thereby solving problems such as the occurrence of a shadow in the main reflecting surface to impair the external appearance, and overcoming the problem whereby the illuminance of irradiation is insufficient. The present invention has an excellent effect in that the invention can be easily worked for producing a vehicle headlamp and in addition has the effects that despite the fact that the lamp is provided with the sub-reflecting surfaces of this kind, it can be manufactured without an increase in the number of separate parts and without the addition of processing steps, thus eliminating an increase in cost.

What is claimed is:

1. A vehicle headlamp, comprising a main reflector formed of molded synthetic resin, said main reflector being arranged to reflect light from a light source in a main beam in a direction along an optical axis of said main reflector;

a rim portion integrally formed with said main reflector during molding of said main reflector, said rim portion extending forwardly of said main reflector substantially in the direction of said optical axis of said main reflector to form an integral carrier portion extending forwardly of said main reflector in said direction of said optical axis; and at least a portion of said extending carrier portion having at least one sub-reflecting surface integrally formed thereon by molding during said molding of said main reflector and carrier portion, said at least one sub-reflecting surface extending substantially linearly lengthwise along said optical axis direction for permitting easy removal of said reflector from a mold during said molding, and for reflecting light impinging on said at least one sub-reflecting surface in a direction other than the direction of said optical axis.

2. The vehicle headlamp of claim 1, wherein said at least one sub-reflecting surface comprises a plurality of substantially flat surfaces extending along said optical axis direction and which are at an angle to each other.

3. The vehicle headlamp of claim 2, wherein said plurality of sub-reflecting surfaces form a zig-zag configuration with the junctions of the surfaces forming said zig-zag extending in said optical axis direction.

4. The vehicle headlamp of claim 1, wherein said at least one sub-reflecting surface is arranged along only one side of said main reflector, so as to reflect light in a direction generally opposite from said one side.

5. The vehicle headlamp of claim 1, wherein said at least one sub-reflecting surface comprises a plurality of sub-reflecting surfaces arranged to form a zig-zag configuration with the junctions of the surfaces forming said zig-zag extending in said optical axis direction.

6. The vehicle headlamp of claim 5, wherein said sub-reflecting surfaces are arranged along only one side of said main reflector, so as to reflect light in the opposite direction from said one side.

7. The vehicle headlamp of claim 1, wherein said main reflector is formed to reflect light in a forward direction of movement of said vehicle, and said at least one web-like sub-reflecting surface comprises a plurality of sub-reflecting surfaces arranged to reflect light to a side portion of the vehicle on which said headlamp is mounted.

* * * * *